US009404291B1

(12) United States Patent
White et al.

(10) Patent No.: US 9,404,291 B1
(45) Date of Patent: Aug. 2, 2016

(54) DEVICE AND METHOD FOR AN ALARMING STRAP TAG

(71) Applicant: Checkpoint Systems, Inc., Thorofare, NJ (US)

(72) Inventors: Shawn G. White, Matthews, NC (US); Scott A. Sattizahn, Fort Mill, SC (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 0 days.

(21) Appl. No.: 14/638,254

(22) Filed: Mar. 4, 2015

(51) Int. Cl.
*E05B 73/00* (2006.01)

(52) U.S. Cl.
CPC ..... *E05B 73/0029* (2013.01); *E05B 73/0011* (2013.01); *E05B 73/0023* (2013.01); *Y10T 70/5004* (2015.04)

(58) Field of Classification Search
CPC ..... E05B 73/0011; E05B 73/0023; E05B 73/0029; Y10T 70/5004
USPC ..... 70/14, 18, 30, 49, 57, 57.1, 58
See application file for complete search history.

(56) References Cited

U.S. PATENT DOCUMENTS 1,141,245 A * 6/1915 Gillespie ..... B65D 63/14 24/18
3,875,771 A * 4/1975 Reisner ..... A45C 13/20 24/167
5,722,266 A * 3/1998 Yeager ..... A45C 13/20 24/18
5,960,652 A * 10/1999 Marmstad ..... E05B 73/0011 70/233
7,162,899 B2 * 1/2007 Fawcett ..... E05B 45/005 242/382
7,168,275 B2 * 1/2007 Fawcett ..... E05B 45/005 242/382
7,522,048 B2 4/2009 Belden, Jr.
7,685,850 B2 * 3/2010 Nilsson ..... E05B 73/0052 242/382
7,992,259 B2 * 8/2011 Goldstein ..... E05B 45/005 24/115 R
8,087,269 B2 * 1/2012 Conti ..... E05B 45/005 242/382
8,122,744 B2 * 2/2012 Conti ..... E05B 45/005 242/382
8,499,595 B2 * 8/2013 Zhang ..... E05B 45/005 70/49
8,528,372 B2 * 9/2013 Nilsson ..... 242/382
9,169,670 B2 * 10/2015 Shute ..... E05B 45/005
2008/0169924 A1 7/2008 Belden, Jr.
2013/0169440 A1 7/2013 Bruhwiler et al.

FOREIGN PATENT DOCUMENTS

DE 112007001705 10/2009
WO WO2008009148 1/2008
WO WO2011153651 12/2011

* cited by examiner

*Primary Examiner* — Suzanne Barrett
(74) *Attorney, Agent, or Firm* — Nelson Mullins Riley & Scarborough LLP

(57) ABSTRACT

A security device may include a rotatable cap and an engagement member. The cap may be graspable by an operator during attachment of the security device to at least a first strap extending substantially around a portion of an object. The engagement member may be configured to engage the first strap. The engagement member may also be substantially fixed in relation to the cap during the attachment of the security device to the first strap and the engagement member may be rotatable with the cap. The security device may be transitioned to a locked state responsive to rotational engagement of the engagement member with the first strap. The rotational engagement of the engagement member with the first strap may also increase tension on the first strap.

19 Claims, 6 Drawing Sheets

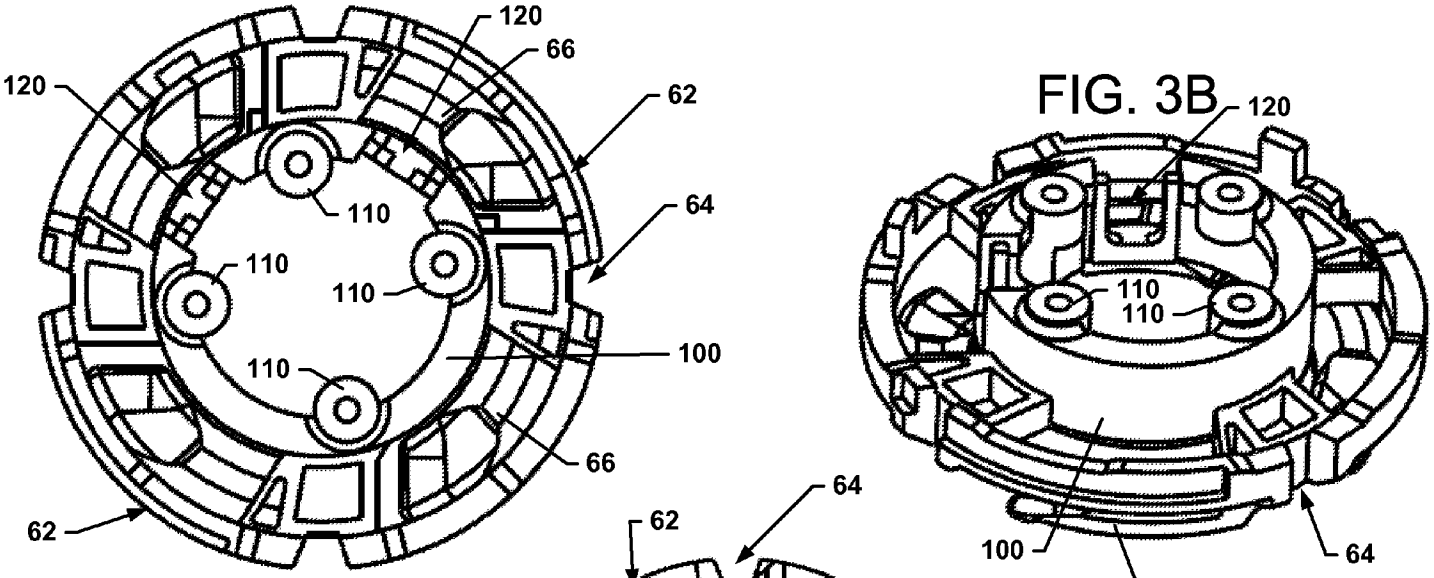
FIG. 3A
FIG. 3B
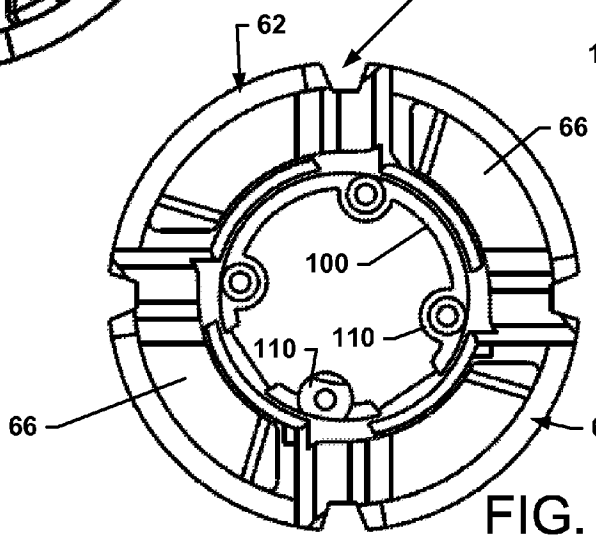
FIG. 3C

DEVICE AND METHOD FOR AN ALARMING STRAP TAG

TECHNICAL FIELD

Various example embodiments relate generally to theft deterrent devices and, more particularly, to a theft deterrent device that is attachable to the straps that are wrapped around various products to detect cutting of the straps.

BACKGROUND

Security devices have continued to evolve over time to improve the functional capabilities and reduce the cost of such devices. Some security devices are currently provided to be attached to individual products or objects in order to deter or prevent theft of such products or objects. In some cases, the security devices include tags or other such components that can be detected by gate devices at the exit of a retail establishment. These gate devices may be sometimes referred to as towers or pedestals. When the security device passes through or proximate to the gates, an alarm or other notification locally at the product and/or at the gates may be triggered. Additionally, a key may be provided at the point of sale terminal so that the security device can be removed when the corresponding products or objects are purchased.

In order to avoid detection at these security gates, and enable removal of products from the store without purchase, some individuals may attempt to remove, tamper with, or destroy the security devices. Thus, the manner by which the security device is attached to the product can be an important consideration. If the security device is easily removable, or can be removed without triggering an alarm function, the security device can be rendered ineffective.

Many products such as, for example, electronic equipment, software and otherwise small and easily pilfered objects, may be to small or oddly shaped to easily permit the attachment of a security device. Accordingly, the security devices for these products may instead be attached to the packaging in which the products are sold. Moreover, in some cases, the products may be placed in larger boxes that are made difficult to open so that the products cannot be removed from the boxes. To make the boxes difficult to open, they may be strapped with belts or straps made of a plastic material. The straps may be clamped around the boxes or other packaging to securely enclose the packaging. The straps generally form a continuous loop of material around the packaging and are welded or fixed with closure sleeves. In many cases, at least two such straps may be wrapped around the packaging such that they cross on opposing sides of the packaging, and each of the straps may extend in a direction substantially perpendicular to the direction of extension of the other. However, in other cases, one strap or straps extending parallel to each other may also be employed.

Given that access to the product may require opening of the package, a thief may typically need to initially remove the straps. Based on the tension provided for the straps, cutting of the straps is normally the only option for removal. If the straps were conductive, perhaps an electronic sensor could directly detect cutting of the straps. However, the straps are typically made of plastic (i.e., non-conducting material) in order to keep their cost down and availability up. As such, detection of the removal of the straps may become more difficult.

BRIEF SUMMARY OF SOME EXAMPLES

Accordingly, some example embodiments may provide devices for improving the capability for securing products by providing a security device that is attachable to straps, and can detect removal of (and sometimes also attempts to remove) the straps.

In one example embodiment, a security device is provided. The security device may include a rotatable cap and an engagement member. The cap may be graspable by an operator during attachment of the security device to at least a first strap extending substantially around a portion of an object. The engagement member may be configured to engage the first strap. The engagement member may also be substantially fixed in relation to the cap during the attachment of the security device to the first strap and the engagement member may be rotatable with the cap. The security device may be transitioned to a locked state responsive to rotational engagement of the engagement member with the first strap. The rotational engagement of the engagement member with the first strap may also increase tension on the first strap.

In some embodiments, the security device described above may include a collar rotatably disposed substantially between the engagement member and the cap. The collar may include at least one reception slot disposed at a lower periphery of the collar to engage the first strap to maintain a fixed orientation relative to the first strap responsive to the rotational engagement of the engagement member with the first strap.

In some embodiments, the engagement member of the security device described above may include alternating upward and downward facing sliding surfaces configured to engage inwardly extending detents provided on a collar. The collar may be rotatably disposed substantially between the engagement member and the cap via engagement between the sliding surfaces and the detents to maintain a fixed orientation relative to the first strap responsive to the rotational engagement of the engagement member with the first strap.

BRIEF DESCRIPTION OF THE SEVERAL VIEWS OF THE DRAWING(S)

Having thus described some embodiments in general terms, reference will now be made to the accompanying drawings, which are not necessarily drawn to scale, and wherein:

FIG. 3A illustrates an isolated, top view of an engagement member of the security device according to an example embodiment;

FIG. 3B illustrates a top, perspective view of the engagement member in accordance with an example embodiment;

FIG. 3C illustrates bottom view of the engagement member in accordance with an example embodiment;

DETAILED DESCRIPTION

Figure 1:
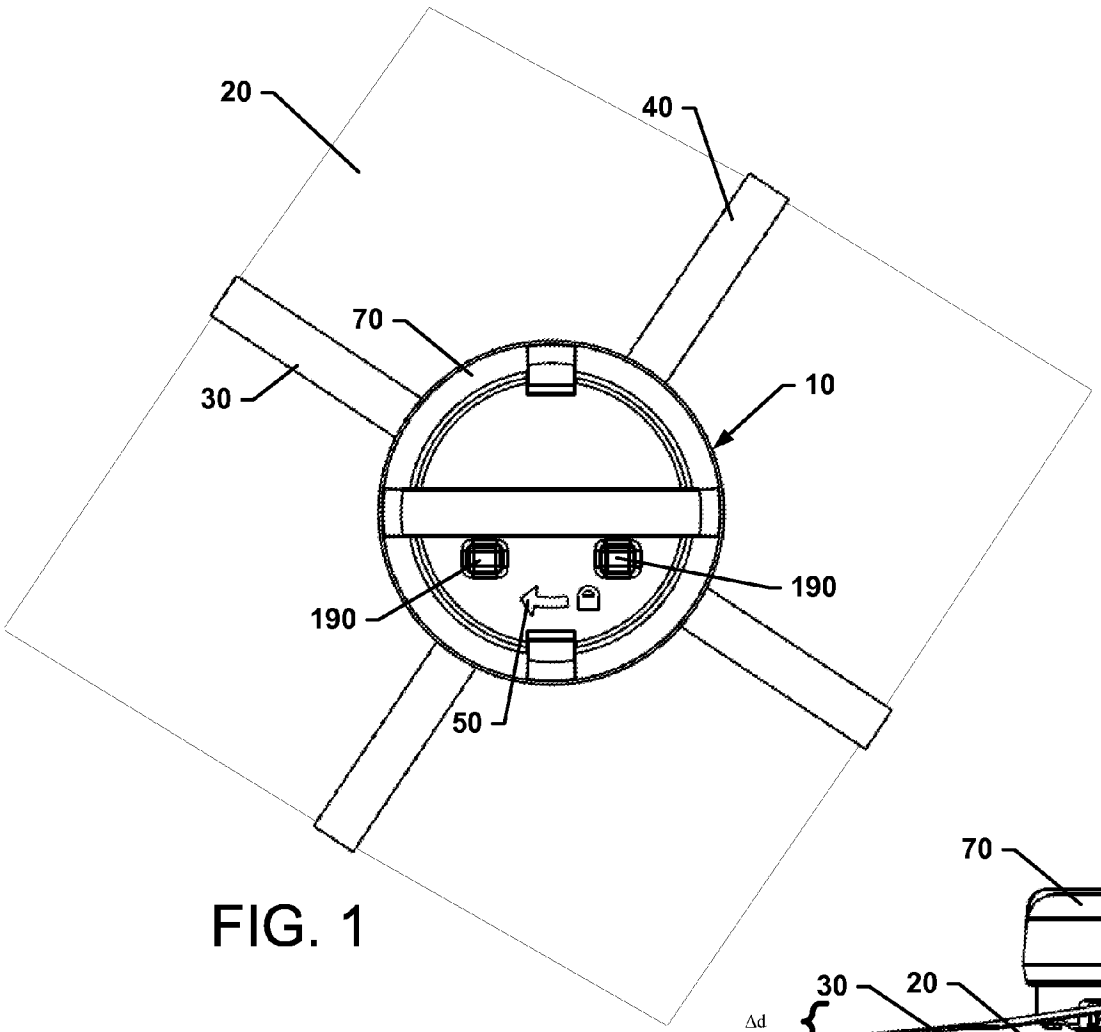
FIG. 1 illustrates a top view of a security device in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may provide a security device (or tag) that is attachable to straps that are affixed around a product (or the packaging of the product). Accordingly, in the context of example embodiments, reference will generally be made to attachment of the security device to an "object," which should be appreciated to represent either or both of a product and its corresponding packaging. The descriptions below will also describe at least some components in terms of relative positioning and/or directions.

In the context of the descriptions provided below, the downward direction should be appreciated as being a direction toward the object of a surface of the object. The upward direction should be appreciated as a direction away from the object or a surface of the object. Thus, the "top" of security device is farthest from the object when the security device is attached to the object, and the "bottom" of the security device is closest (or proximate to) the object when the security device is attached to the object. The same reference directions also apply even if the security device is not attached to the object, as only the "bottom" of the security device is configured to engage the object. Any relative terms such as "above" or "below" should also then be understood in reference to the lowest or bottom part of the security device being that part of the security device that is configured to be closest to the object when the security device is attached to the object.

Figure 2:
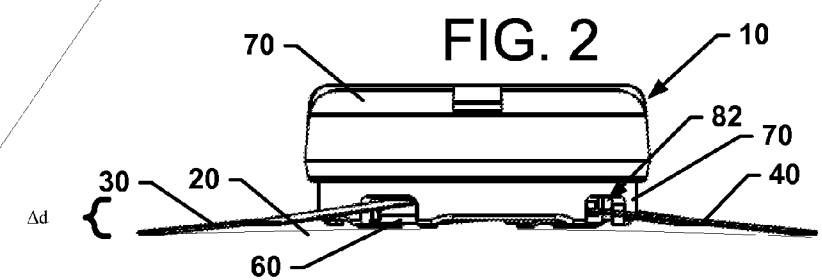
FIG. 2 illustrates a side view of the security device in accordance with an example embodiment.

FIG. 1 illustrates a top view of a security device 10, and FIG. 2 shows a side view of the security device 10 in accordance with an example embodiment. In reference to FIGS. 1 and 2, the security device 10 may be operably coupled to an object 20 that is further secured with one or more straps. In this regard, the straps may include a first strap 30 extending around the object 20 along a first direction (e.g., a longitudinal direction) and a second strap 40 extending around the object 20 along a second direction (e.g., a latitudinal direction). In some cases, the first and second directions may be substantially perpendicular to each other. However, in other cases, only a single strap may be employed, or the first and second straps 30 and 40 may be extended around the object substantially parallel to each other. Other configurations are also possible for the straps without limitation. Further, in some cases, at least some tension may be applied on the object 20 via application of the first and second straps 30 and 40.

As shown in FIGS. 1 and 2, the security device 10 may be attached to at least one of the straps. Moreover, in embodiments in which straps that cross each other are employed, the security device 10 may be attached to the straps at a location proximate to a point of intersection between the first strap 30 and the second strap 40. In an example embodiment, the security device 10 may be attached to the straps in a manner that at least partially increases the tension applied to the object 20 by each of the straps that the security device 10 engages. Thus, for example, when the security device 10 engages the first and second straps 30 and 40, each of the first and second straps 30 and 40 may be further tensioned relative to their respective engagements with the object by virtue of the engagement between the security device 10 and the first and second straps 30 and 40.

In some embodiments, the security device 10 may have a locked state and an unlocked state. The unlocked state may generally be the initial state in which the security device 10 is provided, and the security device 10 may be transitioned into the locked state in connection with the attachment of the security device to the first and second straps 30 and 40. Thus, for example, the security device 10 may be placed proximate to the point of intersection between the first and second straps 30 and 40, and the security device 10 may be rotated to engage the security device 10 to the first and second straps 30 and 40. When the rotation (which may be provided in the direction of arrow 50—e.g., clockwise in this example) reaches a physical limit such that the first and second straps 30 and 40 are engaged by the security device 10, the security device 10 may simultaneously (or otherwise in connection with such rotation) be transitioned to the locked state. Once in the locked state, the security device 10 may be configured to alarm (locally or remotely) if the connection with the first strap 30 or the second strap 40 is compromised. The compromising of the connection may be detectable based on a reduction of tension of either of the first strap 30 or the second strap 40.

As shown in FIG. 2, the security device 10 may include an engagement member 60 that may be configured to engage the first and second straps 40 responsive to the rotation in the direction of arrow 50. The engagement member 60 may interface with a cap 70 and rotate responsive to turning of the cap 70. Thus, for example, the operator may grasp the cap 70 and turn the cap 70 in the clockwise direction to impart the same turning motion onto the engagement member 60. The security device 10 may also include a collar 80 that may have reception slots 82 disposed substantially at 90 degree intervals around a lower periphery of the collar 80. The reception slots 82 may receive the first and second straps 30 and 40 and remain fixed with the first and second straps 30 and 40, respectively, during rotation of the cap 70 and the engagement member 60 responsive to rotation in the direction of arrow 50. In other words, during rotation, the straps 30 and 40 remain engaged in the reception slots 82 to prevent lateral movement of the straps as the straps engage with the engagement member 60 (and lift ramps 66 as described herein).

While the collar 80 engages the first and second straps 30 and 40 (and is substantially fixed relative thereto), the engagement member 60 may lift the first and second straps 30 and 40 during the rotation of the cap 70 and the corresponding process of engaging the first and second straps 30 and 40, as can be seen in FIG. 2. As such, the first and second straps 30 and 40 may initially be relatively close to, or even parallel with, a surface of the object 20 when the engagement member 60 is placed proximate to the point of intersection between the first strap 30 and the second strap 40. The engagement member 60 may slightly displace or push on a surface of the object 20 to allow the engagement member 60 to engage the first and second straps 30 and 40. Then responsive to rotation of the cap 70 and the engagement member 60, the engagement member 60 may receive and engage the first and second straps 30 and 40 and simultaneously lift the first and second straps 30 and 40 slightly away from the surface of the object 20 to thereby increase the tension on the first and second straps 30 and 40 while the engagement member 60 and the cap 70 rotate relative to the first and second straps 30 and 40 and the collar 80. After the first and second straps 30 and 40 are engaged and the security device 10 is transitioned to the locked state (as described in greater detail below), the engagement member 60 (and the bottom surface of the collar 80) may rest on the surface of the object 20 and maintain the first and second straps 30 and 40 under the increased tension provided by the engagement. While the engagement member 60 rests on the surface of the object 20, the first and second straps 30 and 40 are maintained at least slightly spaced apart from the surface of the object proximate to the security device 10 to maintain the increased tension.

Figure 3E:
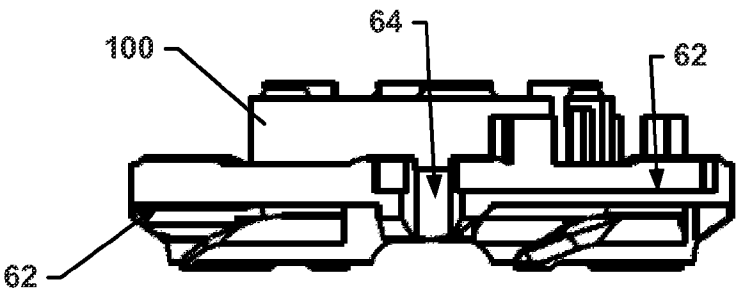
FIG. 3E shows another side view from different perspective of the engagement member of FIG. 3D rotated about 90 degrees in accordance with an example embodiment.
Figure 3D:
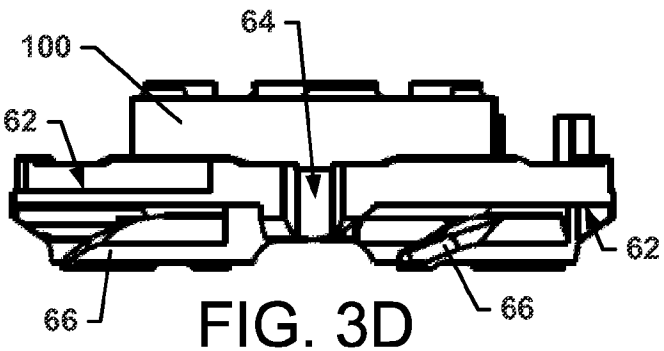
FIG. 3D illustrates a side view of the engagement member in accordance with an example embodiment.
Figure 4A:
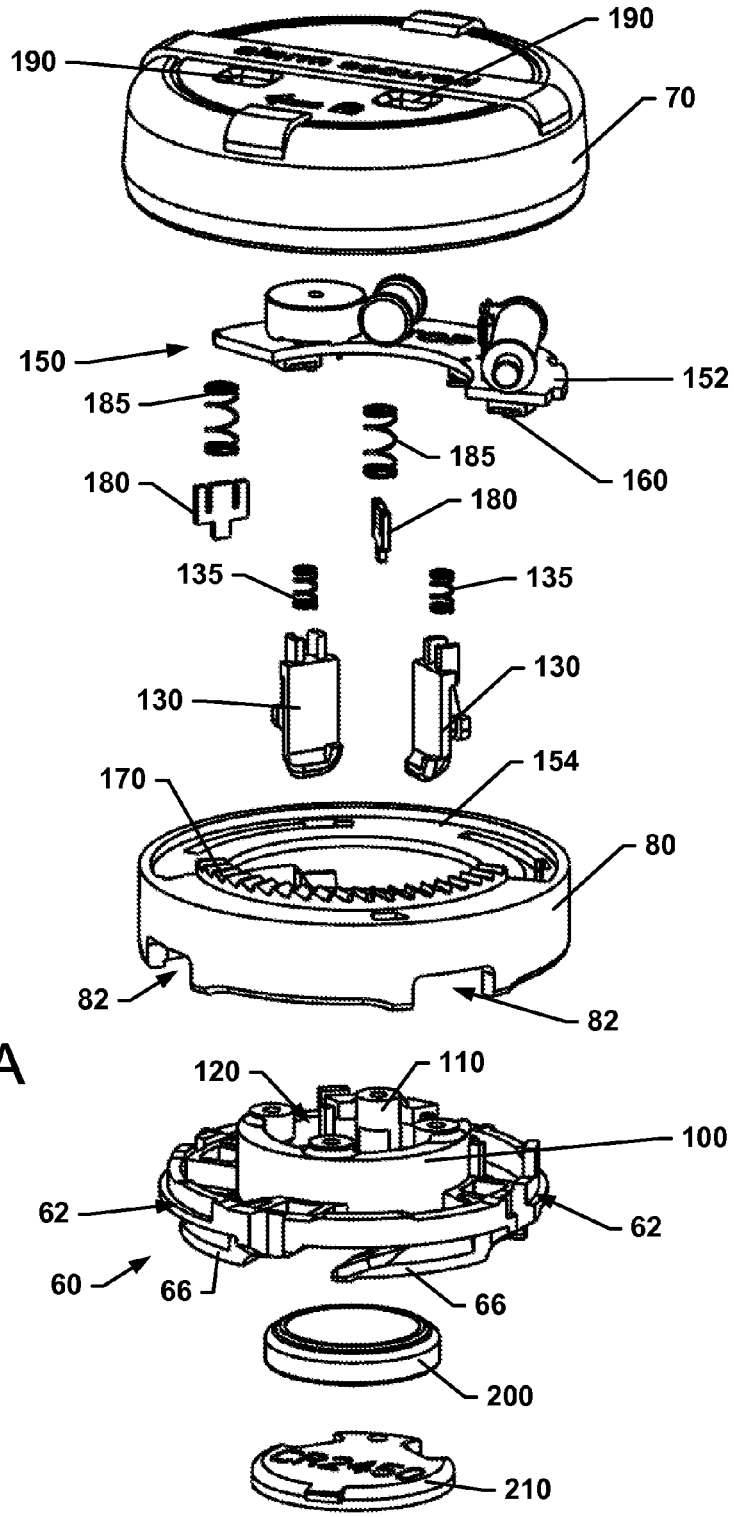
FIG. 4A is an exploded, top perspective view of the security device in accordance with an example embodiment.
Figure 4B:
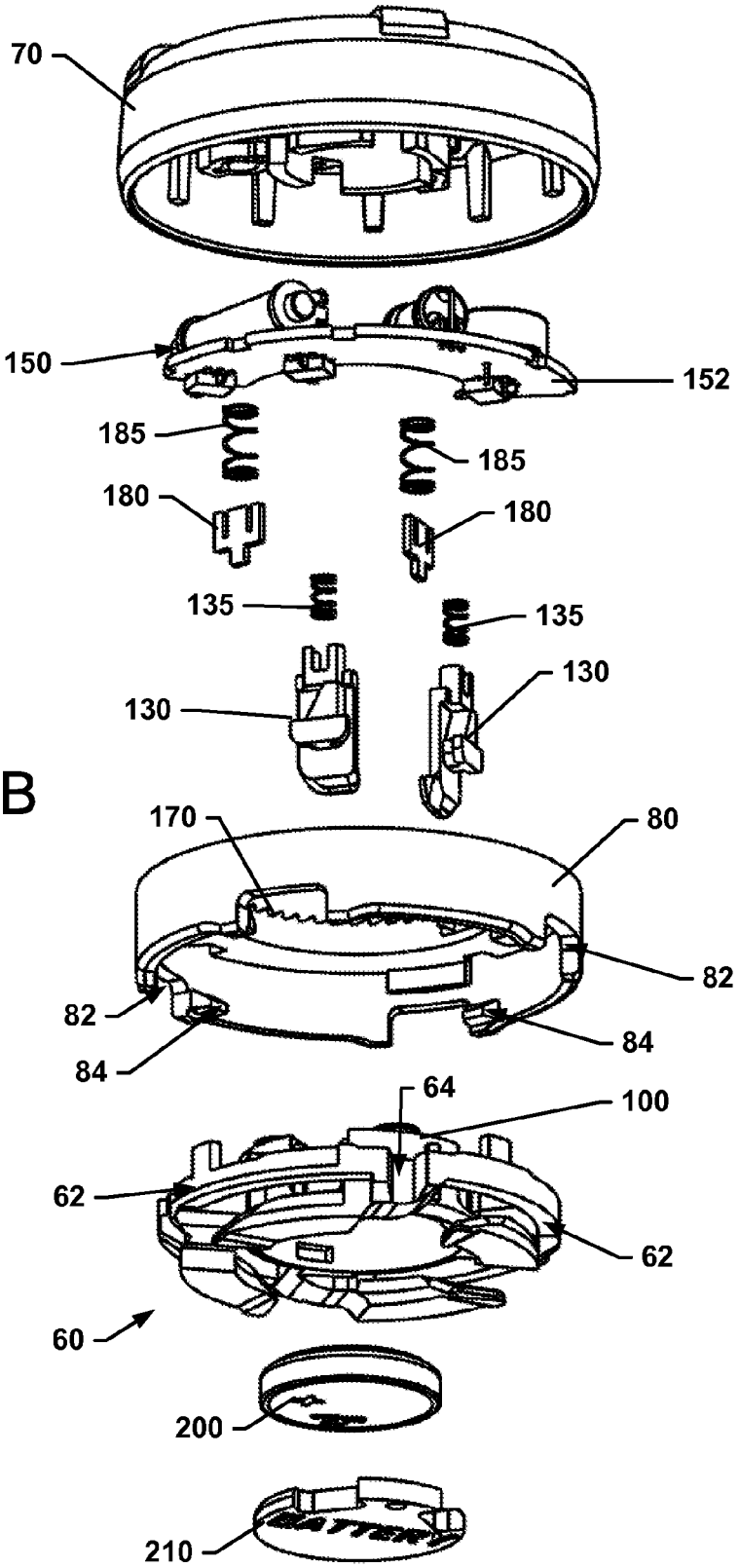
FIG. 4B is an exploded, bottom perspective view of the security device in accordance with an example embodiment.
Figure 4C:
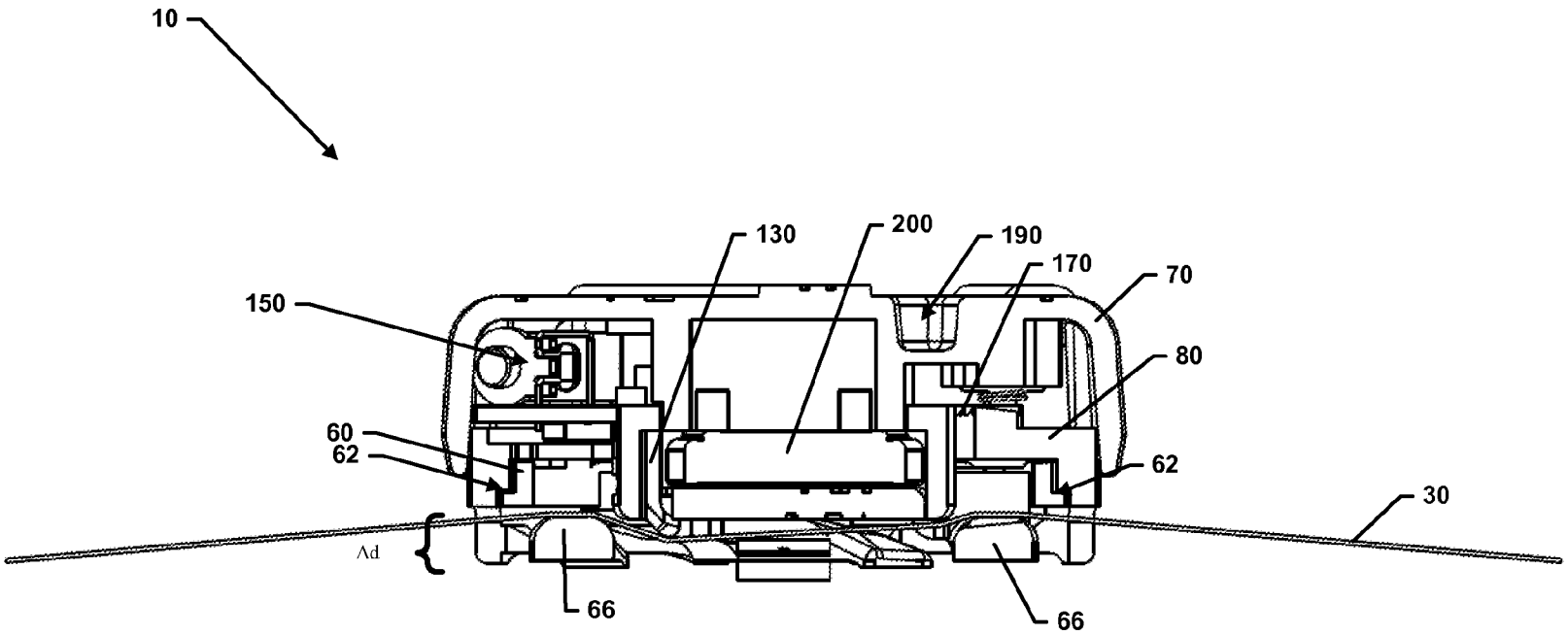
FIG. 4C is a cross sectional, side view of the security device to illustrate how the components of FIGS. 4A and 4B may fit together in accordance with an example embodiment.

A further description of some components of the security device 10 in accordance with an example embodiment will now be described in reference to FIGS. 3 and 4. FIG. 3, which includes FIGS. 3A, 3B, 3C, 3D and 3E, shows various views of the engagement member 60 in isolation according to example embodiment. In this regard, FIG. 3A illustrates an isolated, top view of the engagement member 60 according to an example embodiment. FIG. 3B illustrates a top perspective view of the engagement member 60, and FIG. 3C illustrates bottom view of the engagement member 60. FIG. 3D illustrates a side view of the engagement member 60 and FIG. 3E shows another side view from a different perspective (e.g., with the engagement member 60 rotated about 90 degrees). FIG. 4, which includes FIGS. 4A, 4B and 4C, illustrates various views of the components that combine to form the security device 10 of an example embodiment. In this regard, FIG. 4A is an exploded, top perspective view of the security device 10 and FIG. 4B is an exploded, bottom perspective view of the security device 10. FIG. 4C is a cross sectional, side view of the security device 10 to illustrate how the components of FIGS. 4A and 4B may fit together in accordance with an example embodiment.

Referring now to FIGS. 3 and 4, it should be appreciated that the collar 80 is disposed rotatably between the engagement member 60 and the cap 70. Although the engagement member 60 and the cap 70 may be fixed relative to each other, the collar 80 may be rotatable within the space provided between the engagement member 60 and the cap 70. Moreover, movement of the collar 80 may be employed in connection with causing the transfer of the security device 10 between the unlocked and locked states. However, it should be appreciated that movement of the collar 80 is relative to the engagement member 60 and the cap 70 when the cap 70 is rotated. The collar 80 actually appears to be substantially fixed relative to the first and second straps 30 and 40.

The collar 80 may include one or more detents 84 that may extend inwardly to engage corresponding sliding surfaces 62 that are disposed on an external periphery of the engagement member 60. The sliding surfaces 62 may extend over an arc of limited length to define a range of motion for the collar 80 to move relative to the engagement member 60 when the cap 70 is rotated. In this regard, the detents 84 may ride over the sliding surfaces 62 over the range of the sliding surfaces 62 when the cap 70 is rotated and the reception slots 82 are engaged with the first and second straps 30 and 40. In some embodiments, the sliding surfaces 62 may be alternately oriented in opposing directions. As such, for example, sliding surfaces 62 on opposite sides of the engagement member 60 may be facing upward, and sliding surfaces 62 between the upward facing surfaces may be facing downward. The detents 84 may be proximate to one side of each of the reception slots 82 to allow for a balanced and supported interface between the collar 80 and the engagement member 60 during rotational movement therebetween. Break-in slots 64 disposed between each of the sliding surfaces 62 may allow the detents 84 to be positioned appropriately proximate to their respective sliding surfaces 62 during construction.

The engagement member 60 may also include lift ramps 66 disposed at a bottom surface thereof. In an embodiment configured to engage two intersecting straps (e.g., the first and second straps 30 and 40), four lift ramps 66 may be provided so that each lift ramp engages a corresponding strap. The lift ramps 66 may have flat bottom surfaces and sloped top surfaces to feed the straps along the sloped top surfaces responsive to rotation of the cap 70 (and therefore also the engagement member 60). In other words, as the lift ramp 66 engages with the strap (e.g., at a pointed tip) and moves towards the strap, the sloped upper surface of the lift ramp 66 causes the strap to travel upward and away from the object, thereby increasing the tension on the strap. Further, the strap can remain laterally stationary within the reception slots 82, as the lift ramp 66 moves relative to the reception slot 82 and the strap. Accordingly, each of the lift ramps 66 may be distributed at 90 degree intervals relative to one another at a bottom portion of the engagement member 60. The lift ramps 66 may generally follow the curvature of the periphery of the engagement member 60 and may be disposed between the outer periphery of the engagement member 60 and a cap support 100 that forms an inner core of the engagement member 60.

The cap support 100 may be a substantially cylindrical structure that is hollow inside. The cap support 100 may include one or more connection towers 110 that may receive a screw, or other protruding member to connect the cap support 100 to the cap 70. In some embodiments, one or more sensor channels 120 may be formed in a portion of the cap support 100 (e.g., between adjacent connection towers 110. The sensor channels 120 may house or otherwise provide a support structure for movable mounting of strap sensors 130. The strap sensors 130 may be displaceable within the sensor channels 120 responsive to the first strap 30 or second strap 40 contacting the strap sensors 130. Although FIGS. 3 and 4 show two strap sensors 130 and two sensor channels 120, it should be appreciated that more or fewer sensor straps 130 and sensor channels 120 could be employed in alternative embodiments.

The strap sensors 130 may be biased downwardly within the sensor channels 120 (e.g., toward a surface of the object 20). Biasing members (e.g., springs 135) may be used to bias the strap sensors 130 away from the cap 70 to an untensioned state. Thus, for example, at least a portion of the strap sensors 130 may extend downward and below a highest portion of the reception slots 82. In some cases, at least a portion of the strap sensors 130 may extend downward to at or near the downward-most extent of the bottom of the lift ramps 66. However, responsive to the first and second straps 30 and 40 being engaged by the lift ramps 66, the first and second straps 30 and 40 may push the strap sensors 130 upward against the biasing members and toward the cap 70 and into a tensioned state. The strap sensors 130 may move approximately a distance $\Delta d$ shown in FIG. 2 when the strap sensors 130 transition to the tensioned state. The distance $\Delta d$ may also represent the approximate distance the first and second straps 30 and 40 are displaced away from the surface of the object 20 when fully engaged by the lift ramps 66 due to rotation of the cap 70 and the engagement body 60 relative to the collar 80 and the first and second straps 30 and 40.

The strap sensors 130 may be operably coupled to a processing assembly 150 that may be housed between the collar 80 and the cap 70. The strap sensors 130 may provide inputs to the processing assembly 150 based on whether the strap sensors 130 are in one or the other of the tensioned state and untensioned state. The processing assembly 150 may be supported on a platform 152 that may be enabled to move in a slide plane 154 disposed on a top side of the collar 80. The platform 152 may be substantially fixed in its position relative to the cap 70, but may slidably engage the slide plane 154 over a range of motion limited by the boundaries of the slide plane 154. In an example embodiment, a switch, sensor or detector 160 may be disposed at one end of the platform 152 to detect when the platform 152 has been rotated relative to the slide plane 154 to reach one end of the slide plane 154. When the detector 160 reaches the end of the slide plane 154, the detector 160 may send a signal to the processing assembly 150 to shift the security device 10 to the locked state. When the detector 160 is not actuated (and therefore not in contact with the end of the slide plane 154), the security device 10 may be in the unlocked state.

The processing assembly 150 may include processing circuitry configured to monitor various inputs and execute alarm functionality and/or other programmable functions based on the inputs received. For example, the processing assembly 150 may monitor input from the detector 160 to determine whether the security device 10 should be in the locked state or unlocked state. The processing assembly 150 may also monitor inputs from the strap sensors 130 to determine whether the first and second straps 30 and 40 are held in the engagement member 60 and tensioned. If the security device 10 is in the unlocked state, the position of the strap sensors 130 may not cause an alarm function to be activated. However, if the security device 10 is in the locked state, a determination that either or both of the strap sensors 130 transitions from the tensioned state to the untensioned state. A transition of the strap sensors 130 from the tensioned state to the untensioned state, while the security device 10 is in the locked state may cause the processing assembly 150 to initiate an alarm function.

In an example embodiment, the collar 80 may include a ratchet plate 170 and one or more ratchet members 180 that may be biased toward engagement with the ratchet plate 170. However, it should be appreciated that the ratchet plate 170 and the ratchet members 180 merely provide one example structure for implementing a locking assembly, and other locking assembly structures are also possible. In some embodiments, the ratchet members 180 may be metallic components biased toward the ratchet plate 170 by biasing members (e.g., springs 185). The springs 185 may be provided between the underside of the cap 70 and the ratchet members 180 to push the ratchet members 180 away from the cap 70 and downward toward the ratchet plate 170. In some cases, the ratchet plate 170 may extend in an arc around a remainder of a portion disposed between the outer and inner peripheries of the collar 80 that is not covered by the slide plane 154.

The ratchet plate 170 may include a plurality of tooth-like or other projections that extend away from the collar 80 and toward the cap 70. The tooth-like projections may be ramped to allow movement of the ratchet members 180 up and over the ramps in one direction only (e.g., the clockwise direction), while the ratchet members 180 are biased to engage the ratchet plate 170. Thus, when the cap 70 is rotated by the operator to engage the first and second straps 30 and 40, the collar 80 may be in a relatively fixed engagement with the first and second straps 30 and 40 and may rotate between the cap 70 and engagement member 60 as the first and second straps 30 and 40 ride up the lift ramps 66 to displace the strap sensors 130 to the tensioned state. The rotation of the collar 80 may also cause the ratchet members 180 to slide along the ramps of the ratchet plate 170 until the detector 160 reaches the end of the slide plane 154 and transitions the security device 10 to the locked state. The ratchet members 180 may then prevent movement of the platform 152 in the counterclockwise direction and hold the detector 160 in place and actuated so that the security device 10 remains in the locked state. Removal of the security device 10 from the locked state (without triggering an alarm function) may therefore require release of the ratchet members 180 from engagement with the ratchet plate 170.

In an example embodiment, the cap 70 may include key holes 190 into which a magnetic key can be inserted. When the magnetic key is inserted into the key holes 190, the magnetic key may have sufficient attractive capacity to pull the ratchet members 180 away from the ratchet plate 170 disengaging the ratchet members 180 from the ratchet plate 170. The collar 80 may then be allowed to rotate and disengage the detector 160 from contact with the end of the slide plane 154, thereby transitioning the security device 10 out of the locked state and to the unlocked state. While in the unlocked state, the security device 10 can be removed from the first and second straps 30 and 40, and the transition of the strap sensors 130 to the untensioned state may not cause any alarm function (since the security device 10 is in the unlocked state).

As an alternative to the locking assembly described above, in some embodiments the ratchet plate 170 could be embodied as or replaced by a structure (e.g., a locking plate) with only one or two locking positions, and the ratchet members 180 (or another locking member) could be configured to engage with the locking positions when rotated sufficiently, and may also be released similar to the manner described above.

In an example embodiment, the processing assembly 150 may be battery powered, and a battery 200 may be disposed in a cavity formed by the hollow portion of the cap support 100. In some cases, a cover 210 may be configured to mate with a bottom of the cavity to enclose the battery 200 substantially within the cavity of the cap support 100. The battery 200 may power the processing assembly 150. The processing assembly 150 may include a processor or other processing device and memory for storing executable instructions or applications. In some cases, the executable instructions or applications may include relatively simple guidance regarding responses to be provided to various inputs or stimuli. For example, the instructions may direct the processing assembly 150 to monitor whether the security device 10 is in the locked state or unlocked state (e.g., based on detector 160 input), and also monitor the strap sensors 130 to determine whether one or both are in the tensioned or untensioned state. If either or both of the strap sensors 130 transition from the tensioned state to the untensioned state while the security device 10 is in the locked state, the processing assembly 150 may initiate the alarm function. Accordingly, if the security device 10 is removed from contact with the first or second straps 30/40, or if either of the first or second straps 30/40 are cut prior to the key being used to allow the ratchet members 180 to be disengaged from the ratchet plate 170 so that the detector 160 can be slid out of contact with the end of the slide plane 154 (to thereby shift to the unlocked state), the processing assembly 150 will initiate the alarm function. The alarm function could be a local alarm, an alarming gate that responds when a portion of the processing assembly 150 is disposed in a field generated by the alarming gate, or another remote alarm.

Additionally, in some cases, a contact sensor may also be provided to sense contact with the object 20. For example, one of the strap sensors 130 could be replaced with a plunger or other such proximity sensor. Alternatively, an additional sensor channel could be added to house the proximity sensor. In any case, the proximity sensor, if employed, may be configured to extend below the bottom of the engagement member 60 to contact the object 20 and be displaced by contact with the object 20. When the proximity sensor contacts the object, a corresponding signal may be provided to the processing assembly 150. The processing assembly 150 may then be configured to initiate the alarm function also if the proximity sensor senses that the security device 10 is no longer proximate to the object 20 by virtue of the proximity sensor being enabled to extend away from the security device 10 by a distance greater than the distance that the proximity sensor lies at in a rest position when proximate to the object (e.g., the throw of the sensor).

In an example embodiment, the security device 10 may therefore be configured to increase tension on the straps by rotational engagement while shifting to a locked state. Thereafter, the tension on the straps can be monitored to initiate an alarm function if the tension on one or both of the straps is lost or otherwise reduced. In an example embodiment, a security device is provided. The security device may include a rotatable cap and an engagement member. The cap may be graspable by an operator during attachment of the security device to at least a first strap extending substantially around a portion of an object. The engagement member may be configured to engage the first strap. The engagement member may also be substantially fixed in relation to the cap during the attachment of the security device to the first strap and the engagement member may be rotatable with the cap. The security device may be transitioned to a locked state responsive to rotational engagement of the engagement member with the first strap. The rotational engagement of the engagement member with the first strap may also increase tension on the first strap.

In some embodiments, the features described above may be augmented or modified, or additional features may be added. These augmentations, modifications and additions may be optional and may be provided in any combination. Thus, although some example modifications, augmentations and additions are listed below, it should be appreciated that any of the modifications, augmentations and additions could be implemented individually or in combination with one or more, or even all of the other modifications, augmentations and additions that are listed. As such, for example, the engagement member may include a lift ramp disposed to translate the rotational movement of the engaging member into vertical movement of the first strap and lift the first strap away from a surface of the object. In some embodiments, the security device may include a collar rotatably disposed substantially between the engagement member and the cap. The collar may maintain a fixed orientation relative to the first strap responsive to the rotational engagement of the engagement member with the first strap. In some embodiments, the security device may further include a first strap sensor biased toward an untensioned state. The first strap sensor may be movable to a tensioned state responsive to the rotational engagement of the engagement member with the first strap. In some embodiments, the collar rotates relative to the cap and the engagement member to transition the security device to the locked state based on a position of the collar relative to the cap and the engagement member. In some embodiments, the security device may further include a processing assembly configured to execute an alarm function responsive to detecting a transition of the first strap sensor to the untensioned state when the security device is in the locked state. The processing assembly may be battery powered. In some embodiments, the processing assembly may be operably coupled to a platform that slides in a slide plane disposed at a surface of the collar responsive to relative motion between the collar and the cap. In such an embodiment, a detector disposed at a portion of the platform may contact an end of the slide plane to cause the security device to transition to the locked state.

In some embodiments, the collar may include a locking (e.g., ratchet) plate, and at least one locking (e.g., ratchet member) may be biased toward contact with the locking plate to enable rotation (e.g., of the collar relative to the cap and engagement member) in a first direction toward the locked state, and prevent rotation in a second direction opposite the first direction (e.g., due to the engagement between the locking member and locking plate). In some embodiments, the cap includes at least one key hole into which a magnetic key is insertable to overcome biasing of the at least one locking member to enable the cap to rotate in the second direction to transition the security device to an unlocked state. As an alternative, one or the other of the collar and the cap may include a locking plate, and at least one locking member may be biased toward contact with the locking plate to enable rotation in a first direction toward the locked state, and prevent rotation in a second direction opposite the first direction. In such an alternative embodiment, the cap may include at least one key hole into which a key is insertable to overcome biasing of the at least one locking member to enable the cap to rotate in the second direction to transition the security device to an unlocked state.

In some embodiments, the security device may further include a proximity sensor configured to detect proximity of the security device to a surface of the object. In some embodiments, the engagement member may be configured to engage the first strap and a second strap disposed about the object substantially perpendicular to the first strap. The engagement member may include four lift ramps each offset from each other by about 90 degrees proximate to a periphery of the engagement member. Adjacent ones of the lift ramps may engage opposite ones of the first and second straps.

In some embodiments, the security device may further include a first strap sensor movable to a tensioned state responsive to the rotational engagement of the engagement member with the first strap and a second strap sensor movable to the tensioned state responsive to the rotational engagement of the engagement member with the second strap. The security device may also include a processing assembly configured to receive inputs from each of the first and second strap sensors and trigger an alarm function responsive to first strap sensor or the second strap sensor transitioning to an untensioned state from the tensioned state while the security device is in the locked state. In some embodiments, the first and second strap sensors may each be disposed within respective sensor channels that extend substantially perpendicular to a direction of extension of the lift ramps. In some embodiments, the first and second strap sensors each contact the first and second straps, respectively, at a point closer to an axis of rotation of the security device than a point at which the first and second straps contact the lift ramps. In some embodiments, the first and second strap sensors may each contact the first and second straps, respectively, at a point closer to a point of intersection of the first and second straps than a point at which the first and second straps contact the lift ramps.

In some embodiments, the security device may include a collar rotatably disposed substantially between the engagement member and the cap. The collar may include at least one reception slot disposed at a lower periphery of the collar to engage the first strap to maintain a fixed orientation relative to the first strap responsive to the rotational engagement of the engagement member with the first strap. In some embodiments, the engagement member may include alternating upward and downward facing sliding surfaces configured to engage inwardly extending detents provided on a collar. The collar may be rotatably disposed substantially between the engagement member and the cap via engagement between the sliding surfaces and the detents to maintain a fixed orientation relative to the first strap responsive to the rotational engagement of the engagement member with the first strap.

Many modifications and other embodiments set forth herein will come to mind to one skilled in the art to which these embodiments pertain having the benefit of the teachings presented in the foregoing descriptions and the associated drawings. Therefore, it is to be understood that the embodiments covered are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A security device comprising:

a rotatable cap graspable by an operator during attachment of the security device to at least a first strap extending substantially around a portion of an object; and an engagement member configured to engage the first strap, the engagement member being substantially fixed in relation to the cap during the attachment of the security device to the first strap and the engagement member being rotatable with the cap, wherein the security device is transitioned to a locked state responsive to rotational engagement of the engagement member with the first strap, wherein the rotational engagement of the engagement member with the first strap increases tension on the first strap, and wherein the engagement member comprises a lift ramp disposed to translate the rotational movement of the engaging member into vertical movement of the first strap and lift the first strap away from a surface of the object.

2. The security device of claim 1, wherein the security device comprises a collar rotatably disposed substantially between the engagement member and the cap, the collar maintaining a fixed orientation relative to the first strap responsive to the rotational engagement of the engagement member with the first strap.

3. The security device of claim 1, further comprising a first strap sensor biased toward an untensioned state, the first strap sensor being movable to a tensioned state responsive to the rotational engagement of the engagement member with the first strap.

4. The security device of claim 3, further comprising a processing assembly configured to execute an alarm function responsive to detecting a transition of the first strap sensor to the untensioned state when the security device is in the locked state.

5. The security device of claim 4, wherein the processing assembly is battery powered.

6. The security device of claim 2, wherein the collar rotates relative to the cap and the engagement member to transition the security device to the locked state based on a position of the collar relative to the cap and the engagement member.

7. The security device of claim 4, wherein the processing assembly is operably coupled to a platform that slides in a slide plane disposed at a surface of a collar responsive to relative motion between the collar and the cap, and wherein a detector disposed at a portion of the platform contacts an end of the slide plane to cause the security device to transition to the locked state.

8. The security device of claim 2, wherein the collar comprises a locking plate, and wherein at least one locking member is biased toward contact with the locking plate to enable rotation in a first direction toward the locked state, and prevent rotation in a second direction opposite the first direction.

9. The security device of claim 8, wherein the cap includes at least one key hole into which a magnetic key is insertable to overcome biasing of the at least one locking member to enable the cap to rotate in the second direction to transition the security device to an unlocked state.

10. The security device of claim 7, wherein one or the other of the collar and the cap comprises a locking plate, and wherein at least one locking member is biased toward contact with the locking plate to enable rotation in a first direction toward the locked state, and prevent rotation in a second direction opposite the first direction.

11. The security device of claim 10, wherein the cap includes at least one key hole into which a key is insertable to overcome biasing of the at least one locking member to enable the cap to rotate in the second direction to transition the security device to an unlocked state.

12. The security device of claim 1, further comprising a proximity sensor configured to detect proximity of the security device to a surface of the object.

13. The security device of claim 1, wherein the engagement member is configured to engage the first strap and a second strap disposed about the object substantially perpendicular to the first strap, the engagement member including four lift ramps each offset by about 90 degrees proximate to a periphery of the engagement member, adjacent ones of the lift ramps engaging opposite ones of the first and second straps.

14. The security device of claim 13, further comprising:

a first strap sensor movable to a tensioned state responsive to the rotational engagement of the engagement member with the first strap;

a second strap sensor movable to the tensioned state responsive to the rotational engagement of the engagement member with the second strap; and a processing assembly configured to receive inputs from each of the first and second strap sensors and trigger an alarm function responsive to first strap sensor or the second strap sensor transitioning to an untensioned state from the tensioned state while the security device is in the locked state.

15. The security device of claim 14, wherein the first and second strap sensors are each disposed within respective sensor channels that extend substantially perpendicular to a direction of extension of the lift ramps.

16. The security device of claim 14, wherein the first and second strap sensors each contact the first and second straps, respectively, at a point closer to an axis of rotation of the security device than a point at which the first and second straps contact the lift ramps.

17. The security device of claim 14, wherein the first and second strap sensors each contact the first and second straps, respectively, at a point closer to a point of intersection of the first and second straps than a point at which the first and second straps contact the lift ramps.

18. A security device comprising:

a rotatable cap graspable by an operator during attachment of the security device to at least a first strap extending substantially around a portion of an object; and an engagement member configured to engage the first strap, the engagement member being substantially fixed in relation to the cap during the attachment of the security device to the first strap and the engagement member being rotatable with the cap, wherein the security device is transitioned to a locked state responsive to rotational engagement of the engagement member with the first strap, wherein the rotational engagement of the engagement member with the first strap increases tension on the first strap, and wherein the security device comprises a collar rotatably disposed substantially between the engagement member and the cap, the collar comprising at least one reception slot disposed at a lower periphery of the collar to engage the first strap to maintain a fixed orientation relative to the first strap responsive to the rotational engagement of the engagement member with the first strap.

19. A security device comprising:

a rotatable cap graspable by an operator during attachment of the security device to at least a first strap extending substantially around a portion of an object; and an engagement member configured to engage the first strap, the engagement member being substantially fixed in relation to the cap during the attachment of the security device to the first strap and the engagement member being rotatable with the cap, wherein the security device is transitioned to a locked state responsive to rotational engagement of the engagement member with the first strap, wherein the rotational engagement of the engagement member with the first strap increases tension on the first strap, and wherein the engagement member comprises alternating upward and downward facing sliding surfaces configured to engage inwardly extending detents provided on a collar, the collar being rotatably disposed substantially between the engagement member and the cap via engagement between the sliding surfaces and the detents to maintain a fixed orientation relative to the first strap responsive to the rotational engagement of the engagement member with the first strap.

* * * * *